US007021103B2

(12) United States Patent
Shore

(10) Patent No.: US 7,021,103 B2
(45) Date of Patent: Apr. 4, 2006

(54) METHOD AND APPARATUS FOR DECELERATING AND TEMPORARILY ACCUMULATING A HOT ROLLED PRODUCT

(75) Inventor: T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 10/832,142

(22) Filed: Apr. 26, 2004

(65) Prior Publication Data

US 2004/0250590 A1 Dec. 16, 2004

Related U.S. Application Data

(60) Provisional application No. 60/470,265, filed on May 14, 2003.

(51) Int. Cl.
*B21B 41/00* (2006.01)

(52) U.S. Cl. ..... 72/231; 72/66; 242/364

(58) Field of Classification Search ..... 72/66, 72/227, 231, 250, 279, 280; 242/361.2, 361.3, 242/361.5, 364, 364.1
See application file for complete search history.

(56) References Cited

U.S. PATENT DOCUMENTS

| | | | |
|---|---|---|---|
| 351,840 | A | 11/1886 | Lenox |
| 1,935,048 | A | 11/1933 | Gassen |
| 3,486,359 | A | 12/1969 | Hein |
| 3,729,972 | A | 5/1973 | Kocks |
| 3,774,433 | A | 11/1973 | Pauels |
| 3,942,350 | A | 3/1976 | Brauer et al. |
| 4,028,920 | A | 6/1977 | Zander |
| 4,310,031 | A | 1/1982 | Appel et al. |
| 4,457,154 | A | 7/1984 | Ohba |
| 5,307,663 | A | 5/1994 | Shore et al. |
| 5,312,065 | A | 5/1994 | Shore et al. |
| 5,595,354 | A | 1/1997 | Josoff |
| 5,893,288 | A | 4/1999 | Shore |

FOREIGN PATENT DOCUMENTS

| | | |
|---|---|---|
| EP | 0 815 973 A1 | 1/1998 |
| JP | 02-2355181 | 9/1990 |
| JP | 5-116845 | 5/1993 |
| JP | 2002-126817 | 5/2002 |

*Primary Examiner*—Lowell A. Larson
(74) *Attorney, Agent, or Firm*—Gauthier & Connors, LLP

(57) ABSTRACT

A method and apparatus is disclosed for decelerating and temporarily accumulating a hot rolled product moving longitudinally along a receiving axis at a first velocity $V_1$. The product is directed through a curved guide having an entry end aligned with the receiving axis to receive the product, and an exit end spaced radially from the receiving axis and oriented to deliver the product in an exit direction transverse to the receiving axis. The curved guide is rotated about the receiving axis in a direction opposite to the exit direction of the product and at a speed at which the guide exit end has a velocity $V_2$, thereby decelerating the product being delivered from the guide exit end to a reduced velocity $V_3$ equal to $V_1-V_2$. The curvature of the guide and the orientation of its exit end is such as to form the delivered product into a helix deposited and temporarily accumulated on a cylindrical drum. The drum is rotated in a direction opposite to the direction of rotation of the curved guide to thereby unwind the product from the drum.

12 Claims, 7 Drawing Sheets

METHOD AND APPARATUS FOR DECELERATING AND TEMPORARILY ACCUMULATING A HOT ROLLED PRODUCT

CROSS REFERENCE TO RELATED APPLICATION

This application claims priority of Provisional Application Ser. No. 60/470,265 filed May 14, 2003.

BACKGROUND OF THE INVENTION

1. Field of the Invention

This invention relates in general to continuous rolling mills producing hot rolled long products such as bars, rods and the like, and is concerned in particular with a method and apparatus for decelerating and temporarily accumulating such products at a selected stage in the hot rolling process.

2. Description of the Prior Art

In the typical rolling mill installation, billets are heated to an elevated rolling temperature in a furnace. The heated billets are then subjected to continuous rolling in successive roughing, intermediate and finishing sections of the mill, with each mill section being comprised of multiple roll stands. For larger products, the entire mill can usually be operated at or close to the maximum capacity of the furnace. However, when the rolling schedule calls for smaller products, the capacity of the finishing section is often reduced to well below that of the furnace and the roughing and intermediate mill sections. Under these circumstances, the roughing and intermediate sections can be slowed to match the capacity of the finishing section, but there are limits beyond which this becomes impractical. This is because acceptable rolling procedure dictates that the heated billets should be introduced into the first stand of the roughing section at a minimum take in speed of not lower than about 0.09–0.1 m/s. Slower take in speeds will likely cause fire cracking of the work rolls.

In other cases, for example, when rolling high speed tool steels or nickel based alloys, a higher take in speed is required to avoid excess cooling of the billet, while lower finishing speeds are required to avoid excessive heat generation, which can cause core melting and surface cracking of the product.

In an exemplary modern day continuous rolling operation, with a furnace capacity of 100–150 tons/hr or greater, a nominal carbon low alloy steel billet with a 150 mm square cross section and a length of 11.7 m is rolled into a 2000 kg. coil. When rolling 5.5 mm diameter rod at the mill's maximum delivery speed of, say, 105 m/s, the take in speed is 0.111 m/sec, which is safely above the acceptable minimum speed. Under these conditions, the mill can produce 64.42 tons/hr (taking into consideration gap and yield). However, if the rolling schedule calls for a 3.5 mm diameter rod, the take in speed for the same size billet at the same maximum delivery speed would have to be lowered to an unacceptably low level of 0.045 m/s, with a corresponding reduction in the mill's tonnage rate to 26.8 tons/hr.

Alternatively, in order to overcome the unacceptably low take in speed, a smaller billet of the same length with, for example, a 106 mm square cross section could be rolled at the maximum delivery speed of 105 m/s and at a safe take in speed of 0.09 m/s. However, this would require a new pass design for the roll stands, different guides, a lowering of the coil weight of the finished product to 1031 kg, and a reduced production rate of 26.31 tons/hr, again taking into consideration gap and yield. The necessity to store different size billets would create further problems.

There exists a need, therefore, for a method and apparatus that will make it possible to roll smaller size products while maintaining the mill take in speeds at or above acceptable minimums, without having to reduce the size of the billets being processed, and preferably while continuing to roll at the mill's maximum tonnage rate.

One prior attempt at achieving this objective is disclosed in U.S. Pat. No. 3,486,359 (Hein), where a laying head temporarily accumulates hot rolled products exiting from the intermediate mill section on a storage reel. The accumulated product is then unwound from the storage reel at a reduced speed for continued rolling in a mill finishing section. A number of drawbacks are associated with the Hein approach. For example, the product is not decelerated prior to being wound onto the storage reel. This, coupled with a lack of control over how the windings are distributed along the reel surfaces, can cause the windings to overlap one another, and this in turn can disrupt the unwinding process.

Also, with the Hein arrangement, the laying head cannot be operated continuously, but instead must be brought to a complete stop at the beginning of each storage cycle so that the product front end can be directed past the storage reel to a downstream stationary pinch roll unit. Thus, during the time required to overcome system inertia and to bring the laying head back up to its operating speed, an unsteady state exists, which can further disrupt the pattern of windings on the storage reel.

The present invention provides an improved method and apparatus for decelerating and temporarily accumulating hot rolled products that differ from the Hein approach in important respects that eliminate the above described drawbacks.

SUMMARY OF THE INVENTION

In accordance with the present invention, a method and apparatus are provided for decelerating and temporarily accumulating a hot rolled product moving longitudinally along a receiving axis at a first velocity $V_1$. The apparatus includes a laying assembly having an entry end aligned with the receiving axis to receive the product. The laying assembly has a curved intermediate section leading to an exit end that is spaced radially from the receiving axis and that is oriented to deliver the product in an exit direction transverse to the receiving axis. The laying assembly is rotated continuously about the receiving axis in a direction opposite to the exit direction of the product and at a speed at which its exit end has a peripheral velocity V2, thereby decelerating the product being delivered therefrom to a reduced velocity $V_3$, equal to $V_1-V_2$. The curvature of the laying assembly and the orientation of its exit end is such that the exiting product is formed into a helix. The helix is received and temporarily accumulated on a cylindrical drum arranged coaxially with the receiving axis. The drum is rotated continuously about the receiving axis in a direction opposite to the direction of rotation of the laying assembly and at a speed selected to unwind the accumulating helix at the velocity $V_3$. The unwinding product is directed away from the drum by a catcher that is shiftable in a direction parallel to the receiving axis. During the time "T" required to roll a complete billet, a product length "L" equal to $T \times V_2$ is temporarily accumulated on the drum.

A preferred embodiment of the invention will now be described in greater detail with reference to the accompanying drawings, wherein:

DETAILED DESCRIPTION OF PREFERRED EMBODIMENTS

Figure 1:
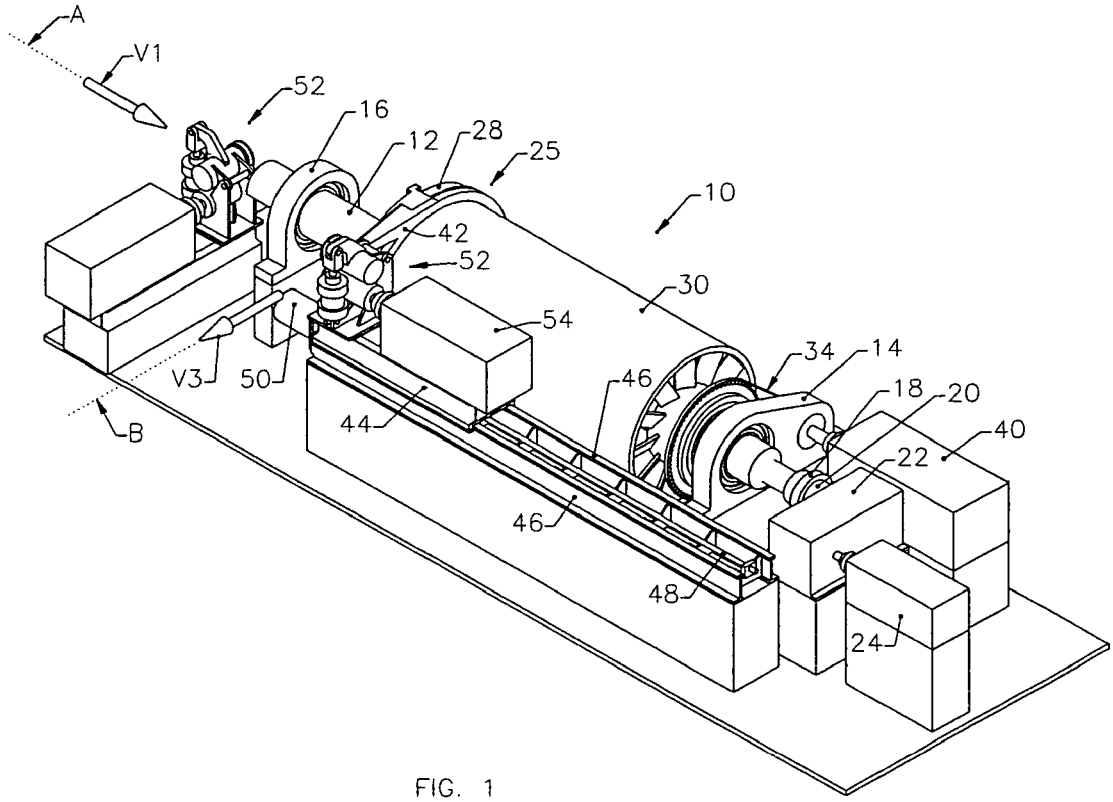
FIG. 1 is a perspective view showing an apparatus in accordance with the present invention awaiting receipt of a hot rolled product.
Figure 2:
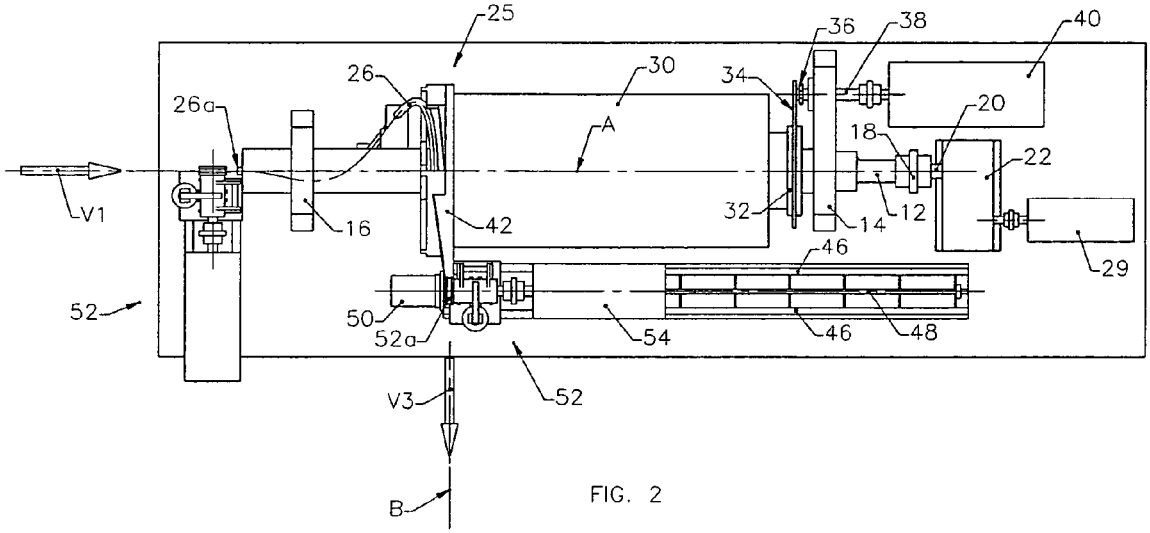
FIG. 2 is a top plan view of the apparatus.
Figure 3:
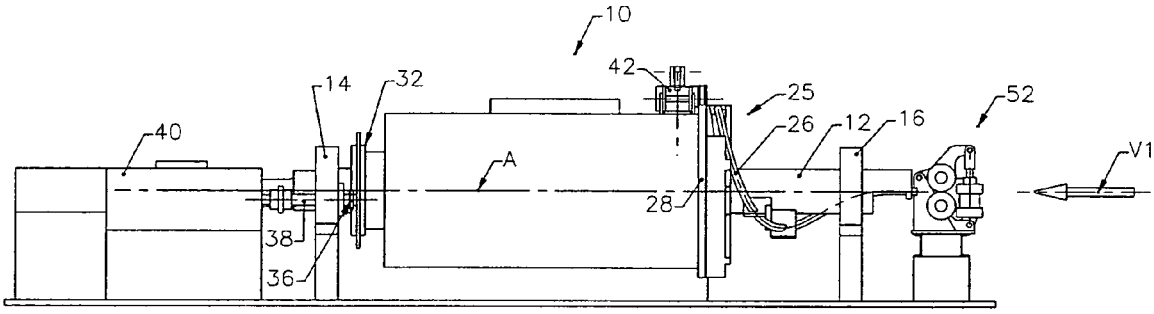
FIG. 3 is a side elevational view of the apparatus.
Figure 4:
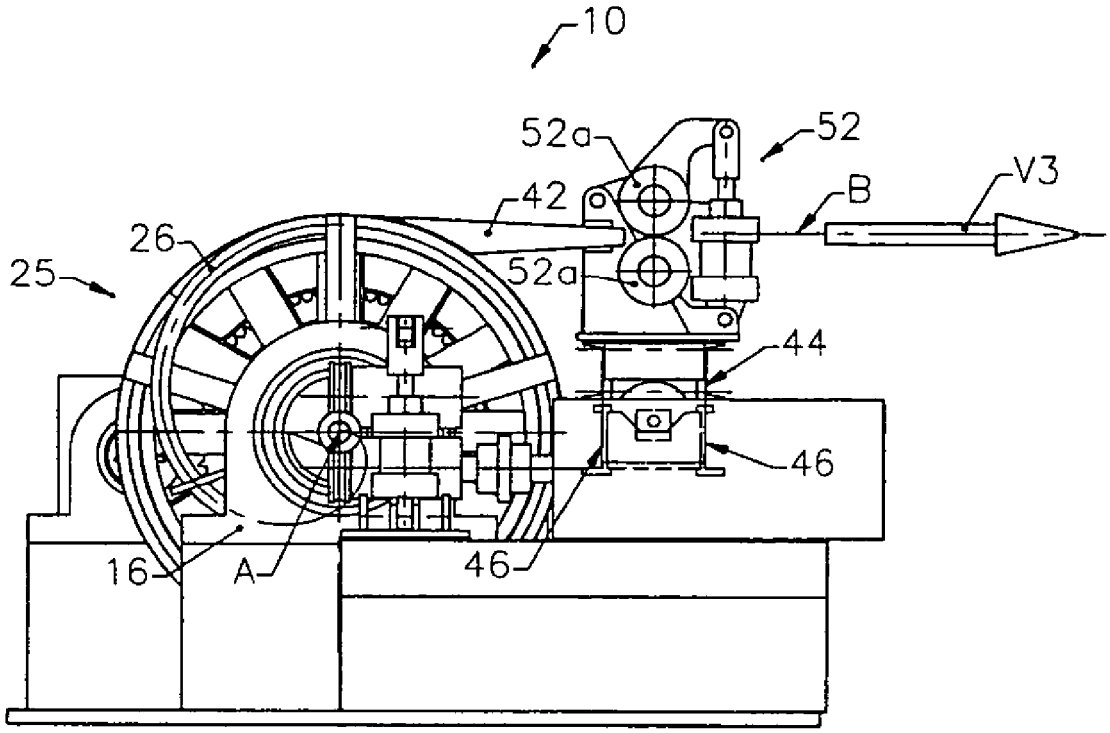
FIG. 4 is an end view taken from the receiving end of the apparatus.
Figure 5:
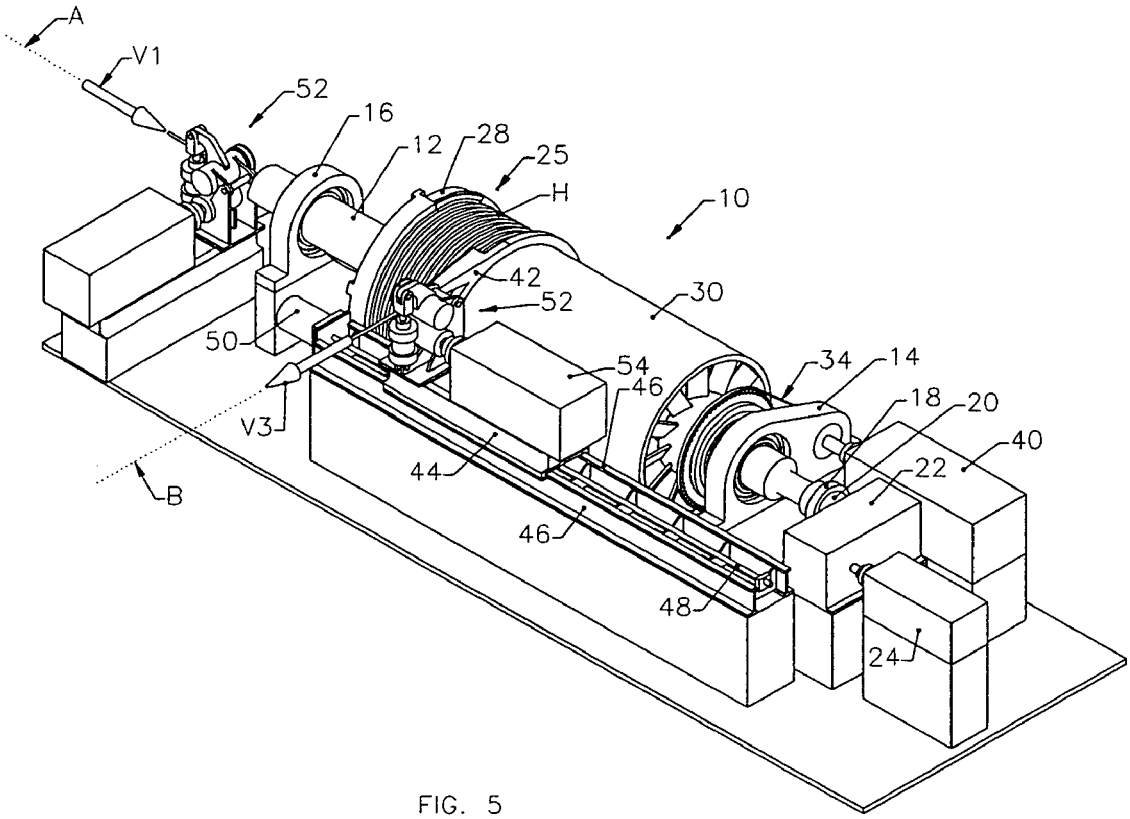
FIG. 5 is a perspective view similar to FIG. 1 showing the apparatus during a decelerating cycle.

Referring initially to FIGS. 1–5, an apparatus in accordance with the present invention is generally depicted at 10 as comprising a laying head drive shaft 12 supported between bearings 14, 16 for rotation about a receiving axis A along which hot rolled product is received at a first velocity $V_1$. One end of the drive shaft is coupled as at 18 to the output shaft 20 of a gear box 22, which in turn is driven by a motor 24.

The opposite end of the drive shaft is configured and arranged to support a curved laying assembly 25 comprising a laying pipe 26 and a helical trough extension 28.

Figure 6:
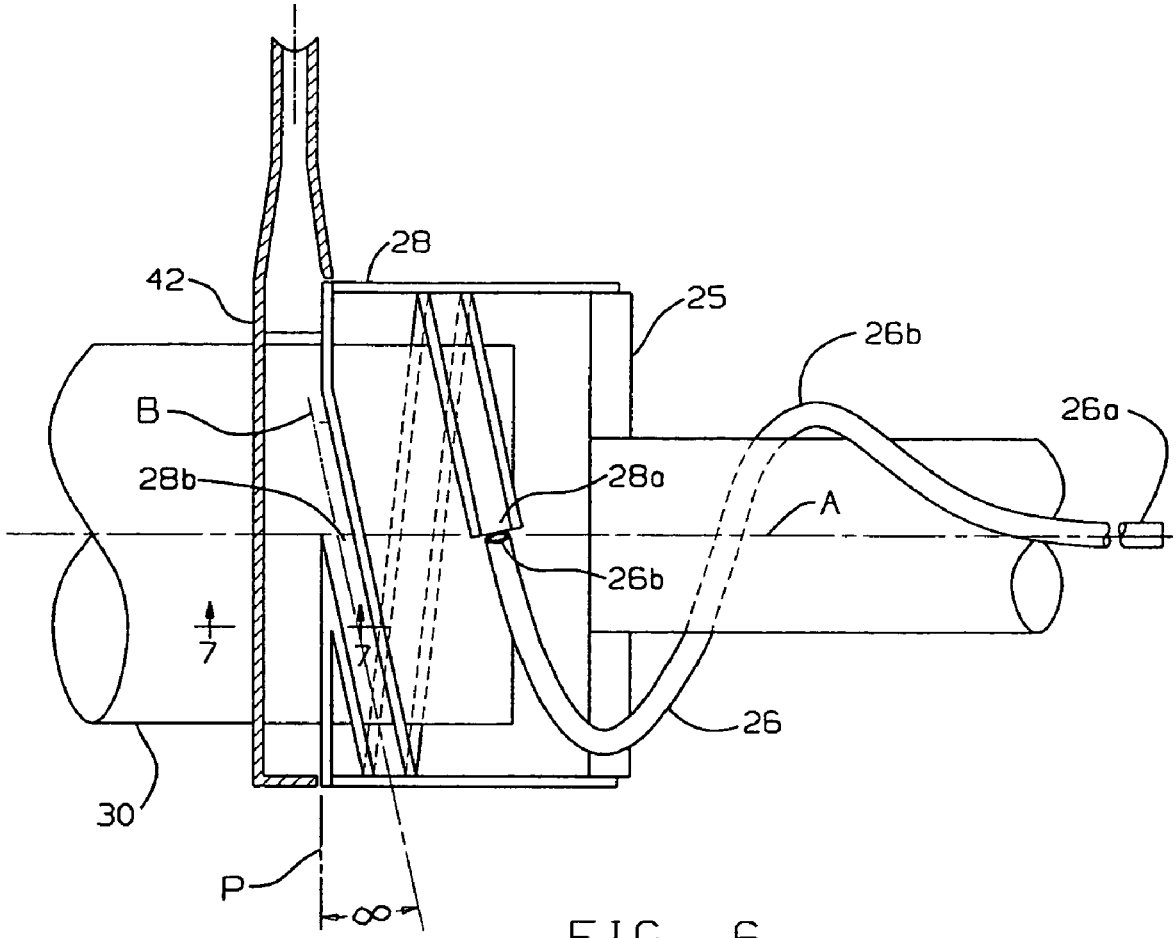
FIG. 6 is a partially sectioned top view of the curved laying assembly and associated catcher.

As can best be seen in FIG. 6, the laying pipe has an entry end 26*a* aligned with the axis A to receive the hot rolled product, and a curved intermediate section 26*b* leading to an exit end 26*c* communicating with the entry end 28*a* of the helical trough 28. The exit end 28*b* of the trough is spaced radially from the axis A and oriented to deliver the product in an exit direction along an axis B transverse to the axis A.

A cylindrical drum 30 is carried by and freely rotatable on the drive shaft 12. One end of the drum is partially overlapped by the exit end 26*c* of the laying pipe 26 and the helical trough 28. A driven sprocket 32 on the opposite end of the drum is mechanically coupled by a drive chain 34 to a drive sprocket 36 on the output shaft 38 of a second motor 40.

The guide trough 28 rotates with the laying pipe 26 and coacts with the drum surface to provide an extension of the guide path defined by the laying pipe. This extension is sufficient to insure that the exiting product is formed into a helical formation of rings.

Figure 7:
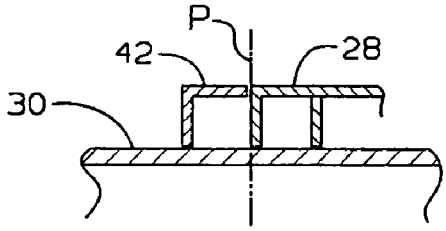
FIG. 7 is a sectional view taken along line 7—7 of FIG. 6.

As can best be seen by further reference to FIGS. 6 and 7, the exit end of the guide trough 28*b* terminates at a plane P perpendicular to the axis A. At the commencement of a deceleration cycle, the product front end is delivered from the trough 28 into a receiving means comprising catcher 42. The curvature of the rotating laying pipe 26 and trough 28 coupled with the orientation of the delivery end 28*b* of the trough results in the product being delivered in the form of a helix H (see FIG. 5). The rings of the helix have a diameter slightly larger than the outside diameter of the drum 30, thus enabling the helix to advance along the drum axis.

Figures 8, 9, 10:
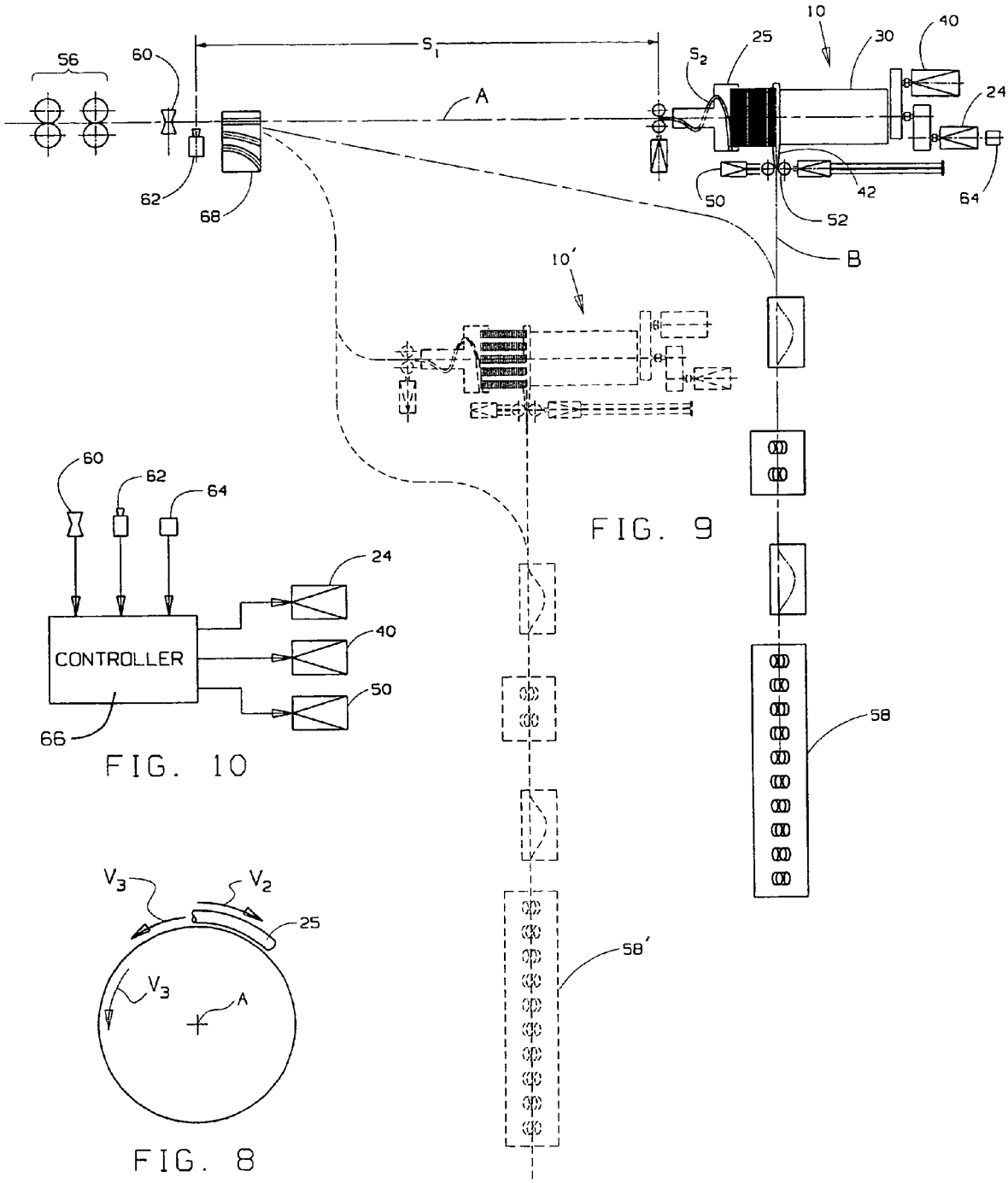
FIG. 8 is a diagrammatic illustration depicting the relative directions of rotation and velocities of the curved laying assembly and cylindrical drum.
FIG. 9 is a schematic layout showing the apparatus in a mill environment.
FIG. 10 is an exemplary control diagram for the apparatus.

With reference additionally to FIG. 8, it will be seen that motor 24 operates to rotate the laying assembly 25 in a direction opposite to the exit direction of the product at circumferential velocity $V_2$ that is less than $V_1$. This results in a deceleration of the exiting product to a velocity $V_3$ equal to $V_1-V_2$.

Motor 40 operates to rotate the drum 30 in a direction opposite to the direction of rotation of the laying assembly 25 and at a speed such that its peripheral velocity is $V_3$, resulting in the product being unwound from the drum into the catcher 42 at velocity $V_3$.

The catcher 42 is carried on a carriage 44 movable along rails 46 parallel to the axis A. Carriage 44 is threadedly engaged by a screw shaft 48 driven by a motor 50. A pinch roll unit 52 having pinch rolls 52*a* driven by a motor 54 is also mounted on the carriage 44. The catcher 42 is arranged to direct the product being delivered from the exit end 28*b* of the trough 28 to the pinch roll unit 52, which operates to propel the product to downstream equipment, e.g., the roll stands of a mill finishing section.

Motor 50 is controlled to maintain the catcher 42 in alignment with the product being unwound from the helix H temporarily accumulating on drum 30. Thus, during an initial stage of the unwinding cycle, motor 50 will operate to traverse the carriage away from the trough 28, and during the final stage of the unwinding cycle, motor 50 will reverse to traverse the carriage back towards the trough.

With reference to FIG. 9, the apparatus 10 is shown positioned between a rolling mill intermediate section 56 and a finishing block 58 comprising the mill finishing section. A velocity gauge 60 measures the velocity of the product exiting from the intermediate mill section 56, and a hot metal detector 62 detects the arrival of a product front end. The distance $S_1$ between the hot metal detector 62 and the entry end of the laying pipe 26 is known, as is the length $S_2$ of the laying pipe and associated trough 28 making up the laying assembly 25. An encoder 64 associated with motor 24 provides a means of determining the exact angular position of the exit end 28*b* of the trough 28 at any given instant.

An exemplary control diagram is illustrated in FIG. 10. A controller 66 receives signals from the velocity gauge 60 and hot metal detector 62 indicative respectively of the velocity $V_1$ of the product and the presence of a product front end. Based on this data, and the known fixed distances $S_1$ and $S_2$, the controller calculates and predicts the exact time of arrival $T_a$ of the product front end at the exit end 28*b* the trough 28.

The signal from encoder 64 enables the controller to predict where the exit end of the trough will be at time $T_a$, and to make adjustments to the speed of motor 24 to insure that the delivery end of the trough is properly located with respect to the catcher at time $T_a$. At time $T_a$, the product front end is delivered from the exit end 28*b* of the trough into the catcher 42, and the controller signals motor 50 to begin traversing the carriage 44 along rails 46 to maintain the catcher in alignment with the product being unwound from accumulating helix H on drum 30.

It will be seen, therefore, that with the present invention, rotation of the laying assembly effects a deceleration of the product from velocity $V_1$ to velocity $V_3$ while simultaneously forming the product length resulting from the velocity differential between V1 and $V_3$ into an ordered helical formation. The laying assembly is rotated continuously, with only minor speed adjustments to insure proper positioning of the trough delivery end 28*b* with reference to the catcher 42 at time $T_a$ when a product front end emerges from the trough delivery end 28*b*.

A second pinch roll unit 52 is advantageously employed in advance of the apparatus to continue propelling the product forward at the velocity $V_1$ after the product tail end drops out of the upstream roll stands of the intermediate mill.

The receiving end of the drum 30 may advantageously be provided with a short helical track to assist in achieving an ordered spacing between the successive rings of the accumulating helix, and the laying pipe 26 and helical trough extension 28 may be rollerized to minimize frictional resistance.

As shown in FIG. 9, the apparatus 10 may be employed in a single strand mode between an intermediate mill section 56 and a finishing section 58, the main advantage here being the ability to roll smaller diameter products at velocity $V_3$ in the finishing section 58 while allowing the preceding mill sections to roll at the higher speed $V_1$.

Thus, for example, the previously described billet with a 150 mm cross section and a length of 11.7 m could be rolled on a continuous mill at a higher and safe take in speed on the order of 0.09 m/s to produce 3.5 mm diameter rod at a finishing speed of 105 m/s. This avoids any need to change the pass design and guides, allows heavier coils to be produced, and eliminates billet inventory problems.

Advantageously, a second decelerator 10' and an additional finishing section 58' can be employed alternatively by means of a switch 68. By employing multiple decelerators 10, 10' and finishing sections 58, 58' to alternatively process successive billet lengths, the entire mill can be operated continuously at the higher delivery velocity $V_1$, resulting in a substantial increase in the rolling capacity of the mill. Thus, for example, with an additional decelerator 10' and finishing mill 58' as shown in FIG. 9, a mill rolling billets having 150 mm cross sections and lengths of 11.7 m into 5.5 mm diameter rods at a delivery speed of 105 m/sec can achieve a tonnage rate approximating that of the furnace output, e.g., 128 tons/hr.

I claim:

1. A method of decelerating and temporarily accumulating a hot rolled product moving longitudinally along a receiving axis at a first velocity $V_1$, said method comprising:

directing said product through a curved guide having an entry end aligned with said axis to receive said product, and an exit end spaced radially from said axis and oriented to deliver said product in an exit direction transverse to said axis;

continuously rotating said curved guide about said axis in a direction opposite to said exit direction and at a speed at which said exit end has a velocity $V_2$, thereby decelerating the product being delivered from said exit end to a reduced velocity $V_3$ equal to $V_1-V_2$, the curvature of said guide and the orientation of said exit end being such as to form the product delivered from said exit end into a helix;

depositing and temporarily accumulating said helix on a cylindrical drum;

rotating said drum in a direction opposite to the direction of rotation of said curved guide to thereby unwind the temporarily accumulated product from said drum;

arranging a second guide to receive the product unwinding from said drum;

determining the time of arrival of the front end of said product at the exit end of said curved guide; and adjusting the rotational speed of said curved guide to position said exit end for delivery of the product front end to said second guide at said time of arrival.

2. The method of claim 1 wherein said drum is rotated at a surface velocity that allows said product to be unwound at velocity $V_3$.

3. The method of claim 1 further comprising reciprocally shifting said second guide in parallel with said axis to maintain said second guide in alignment with the product being unwound from said drum.

4. The method as claimed in claim 1 further comprising forcibly advancing the product along said axis into said curved guide.

5. A method of decelerating and temporarily accumulating a hot rolled product moving longitudinally along a receiving axis at a first velocity $V_1$, said method comprising:

directing said product through a curved guide having an entry end aligned with said axis to receive said product, and an exit end spaced radially from said axis and oriented to deliver said product in an exit direction transverse to said axis;

rotating said curved guide about said axis in a direction opposite to said exit direction and at a speed at which said exit end has a velocity $V_2$, thereby decelerating the product being delivered from said exit end to a reduced velocity $V_3$ equal to $V_1-V_2$, the curvature of said guide and the orientation of said exit end being such as to form the product delivered from said exit end into a helix;

depositing and temporarily accumulating said helix on a cylindrical drum; and rotating said drum in a direction opposite to the direction of rotation of said curved guide and at a surface velocity causing said product to be unwound from said drum at velocity $V_3$;

providing a second guide for receiving the product being unwound from said drum; and reciprocally shifting said second guide in parallel with said axis to maintain said second guide in alignment with the product being unwound from said drum.

6. Apparatus for decelerating a hot rolled product moving longitudinally along an axis at a first velocity $V_1$, said apparatus comprising:

a curved guide having an entry end aligned with said axis to receive said product, and having an exit end spaced radially from said axis and orientated to deliver said product in an exit direction transverse to said axis;

a first drive means for continuously rotating said curved guide about said axis in a direction opposite to said exit direction and at a speed at which said exit end has a second velocity $V_2$ such that said product is delivered from said exit end in the form of a helix and at a third velocity $V_3$ equal to $V_1-V_2$;

a cylindrical drum rotatable about said axis and arranged to axially receive said helix;

a second drive means for rotating said drum in a direction opposite to the direction of rotation of said curved guide and at a speed such that said product is unwound from said drum at said third velocity;

receiving means for receiving the product being unwound from said drum; and control means for determining the arrival time of the front end of said product at the exit end of said curved guide and for adjusting the rotational speed of said curved guide to rotatably locate said exit end at the angular position required to deliver the product front end to said receiving means.

7. The apparatus as claimed in claim 6 wherein a receiving end of said drum is overlapped by the exit end of said curved guide.

8. The apparatus as claimed in claim 6 wherein said receiving means comprises a carriage movable along a track parallel to said axis, a second guide positioned on said carriage to receive the product unwinding from said drum, and a third drive means for moving said carriage along said track to maintain said second guide in alignment with the unwinding product.

9. The apparatus as claimed in claim 6 further comprising means forcibly advancing the product along said axis and into said curved guide.

10. The apparatus of claim 6 or 9 further comprising means for forcibly retracting the product being unwound from said drum.

11. Apparatus for decelerating a hot rolled product moving longitudinally along an axis at a first velocity $V_1$, said apparatus comprising:

a curved guide having an entry end aligned with said axis to receive said product, and having an exit end spaced radially from said axis and orientated to deliver said product in an exit direction transverse to said axis;

a first drive means for rotating said curved guide about said axis in a direction opposite to said exit direction and at a speed at which said exit end has a second velocity $V_2$ such that said product is delivered from said exit end in the form of a helix and at a third velocity $V_3$ equal to $V_1-V_2$;

a cylindrical drum rotatable about said axis, said drum having a receiving end overlapped by the exit end of said curved guide and arranged to axially receive said helix;

a second drive means for rotating said drum in a direction opposite to the direction of rotation of said curved guide and at a speed such that said product is unwound from said drum at said third velocity;

receiving means for receiving the product being unwound from said drum, said receiving means comprising a carriage moveable along a track parallel to said axis, a catcher positioned on said carriage to receive the product unwinding from said drum; and a third drive means for moving said carriage along said track to maintain said catcher in alignment with the unwinding product.

12. A method of decelerating and temporarily accumulating a hot rolled product moving longitudinally along a receiving axis at a first velocity $V_1$, said method comprising:

directing said product through a curved guide having an entry end aligned with said axis to receive said product, and an exit end spaced radially from said axis and oriented to deliver said product in an exit direction transverse to said axis;

continuously rotating said curved guide about said axis in a direction opposite to said exit direction and at a speed at which said exit end has a velocity $V_2$, thereby decelerating the product being delivered from said exit end to a reduced velocity $V_3$ equal to $V_1-V_2$, the curvature of said guide and the orientation of said exit end being such as to form the product delivered from said exit end into a helix;

depositing and temporarily accumulating said helix on a cylindrical drum;

rotating said drum in a direction opposite to the direction of rotation of said curved guide and at a surface velocity allowing said product to be unwound from said drum at velocity $V_3$;

providing a second guide for receiving the product being unwound from said drum;

rotatably locating the exit end of said curved guide with respect to said second guide at the time of arrival of the front end of said product at said exit end to thereby deliver the product front end to said second guide; and maintaining said second guide in alignment with the product being unwound from said drum.

* * * * *